US008298039B2

(12) United States Patent
Liu

(10) Patent No.: US 8,298,039 B2
(45) Date of Patent: Oct. 30, 2012

(54) TWO-WHEEL TOY CAR

(75) Inventor: Bao-Shuai Liu, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 741 days.

(21) Appl. No.: 12/491,250

(22) Filed: Jun. 25, 2009

(65) Prior Publication Data

US 2010/0261407 A1 Oct. 14, 2010

(30) Foreign Application Priority Data

Apr. 14, 2009 (CN) ..... 2009 1 0301557

(51) Int. Cl.
*A63H 17/00* (2006.01)
*A63H 17/267* (2006.01)

(52) U.S. Cl. ..... 446/465; 446/431; 446/448; 446/470

(58) Field of Classification Search ..... 446/431, 446/448, 465, 470
See application file for complete search history.

(56) References Cited

U.S. PATENT DOCUMENTS 2,096,333 A * 10/1937 Marx ..... 446/460
2,121,355 A * 6/1938 Krupp ..... 446/460
2,770,074 A * 11/1956 Jones et al. ..... 446/442
3,938,608 A * 2/1976 Folco-Zambelli ..... 180/21
4,034,502 A * 7/1977 Breslow et al. ..... 446/289
4,161,793 A * 7/1979 Merchan ..... 4/476
4,223,753 A * 9/1980 Bradbury ..... 180/6.2
4,290,228 A * 9/1981 Goldfarb et al. ..... 446/288
4,306,329 A * 12/1981 Yokoi ..... 15/319
4,457,101 A * 7/1984 Matsushiro ..... 446/456
4,515,235 A * 5/1985 Yamamoto et al. ..... 180/168
4,702,718 A * 10/1987 Yanase ..... 446/175
4,846,758 A * 7/1989 Chou ..... 446/437
5,019,009 A * 5/1991 Chao-Chin et al. ..... 446/437
5,542,872 A * 8/1996 Ho ..... 446/440
5,549,501 A * 8/1996 Jow ..... 446/460
5,554,914 A * 9/1996 Miyazawa ..... 318/568.11
5,618,219 A * 4/1997 Simone et al. ..... 446/456
5,709,583 A * 1/1998 Suto et al. ..... 446/440
5,746,641 A * 5/1998 Wong ..... 446/431
5,839,941 A * 11/1998 Chen ..... 446/442
5,862,703 A * 1/1999 Tsai ..... 74/53
5,868,600 A * 2/1999 Watanabe ..... 446/460
6,119,057 A * 9/2000 Kawagoe ..... 701/23
6,152,801 A * 11/2000 Tsai ..... 446/470

(Continued)

*Primary Examiner* — Gene Kim
*Assistant Examiner* — Alexander Niconovich
(74) *Attorney, Agent, or Firm* — Altis Law Group, Inc.

(57) ABSTRACT

A two-wheel toy car includes a car body, a chassis for supporting the car body, a wheel assembly, and two balancing assemblies fixed to the chassis. The chassis includes an inner surface facing the car body and symmetrically defines two through holes. The wheel assembly includes two wheels symmetrically positioned on the chassis and two driving members corresponding to the wheels, respectively. The balancing assemblies correspond to the through holes, respectively. Each balancing assembly includes a guiding member fixed to the inner surface corresponding to the through hole, a contacting member extending from the through hole, and at least one elastic member positioned between the guiding member and the contacting member. The contacting member faces the guiding member and is slidably connected to the guiding member. One end of the elastic member abuts against the guiding member, and the other end of the elastic member abuts against the contacting member.

12 Claims, 7 Drawing Sheets

U.S. PATENT DOCUMENTS 6,459,955 B1 * 10/2002 Bartsch et al. ..... 700/245
6,481,515 B1 * 11/2002 Kirkpatrick et al. ..... 180/65.1
6,581,703 B2 * 6/2003 Hammonds ..... 180/6.2
6,641,457 B1 * 11/2003 Lai ..... 446/465
6,726,524 B2 * 4/2004 Yamaguchi et al. ..... 446/431
6,883,201 B2 * 4/2005 Jones et al. ..... 15/319
6,988,929 B2 * 1/2006 Wong ..... 446/462
7,213,663 B2 * 5/2007 Kim ..... 180/6.5
7,291,053 B2 * 11/2007 Mukaida ..... 446/275
7,320,149 B1 * 1/2008 Huffman et al. ..... 15/320
7,346,428 B1 * 3/2008 Huffman et al. ..... 700/245
7,397,214 B2 * 7/2008 Hashimoto et al. ..... 318/568.12
7,430,455 B2 * 9/2008 Casey et al. ..... 700/245
7,571,511 B2 * 8/2009 Jones et al. ..... 15/319
7,581,611 B1 * 9/2009 Kratz ..... 180/222
7,712,556 B2 * 5/2010 Hammonds ..... 180/6.5
7,893,646 B2 * 2/2011 Yourlo et al. ..... 318/568.12
8,025,551 B2 * 9/2011 Torres et al. ..... 446/431
8,092,272 B2 * 1/2012 Yang ..... 446/465
8,142,254 B1 * 3/2012 Greenley et al. ..... 446/460
2009/0325461 A1 * 12/2009 Liu et al. ..... 446/470

* cited by examiner

TWO-WHEEL TOY CAR

BACKGROUND

1. Technical Field

The present disclosure relates to toys technology, and particularly, to a two-wheel toy car.

2. Description of Related Art

A two-wheel toy car includes a car body, a chassis for supporting the car body, two wheels symmetrically fixed to the chassis, and a driving unit fixed in the car body and configured for driving the two wheels. The two-wheel toy car is supported by the two wheels on the ground. However, this configuration may result in the two-wheel toy car being unstable when in motion.

Therefore, what is needed is to provide a two-wheel toy car, which can overcome the above-mentioned problem.

DETAILED DESCRIPTION

Figure 1:
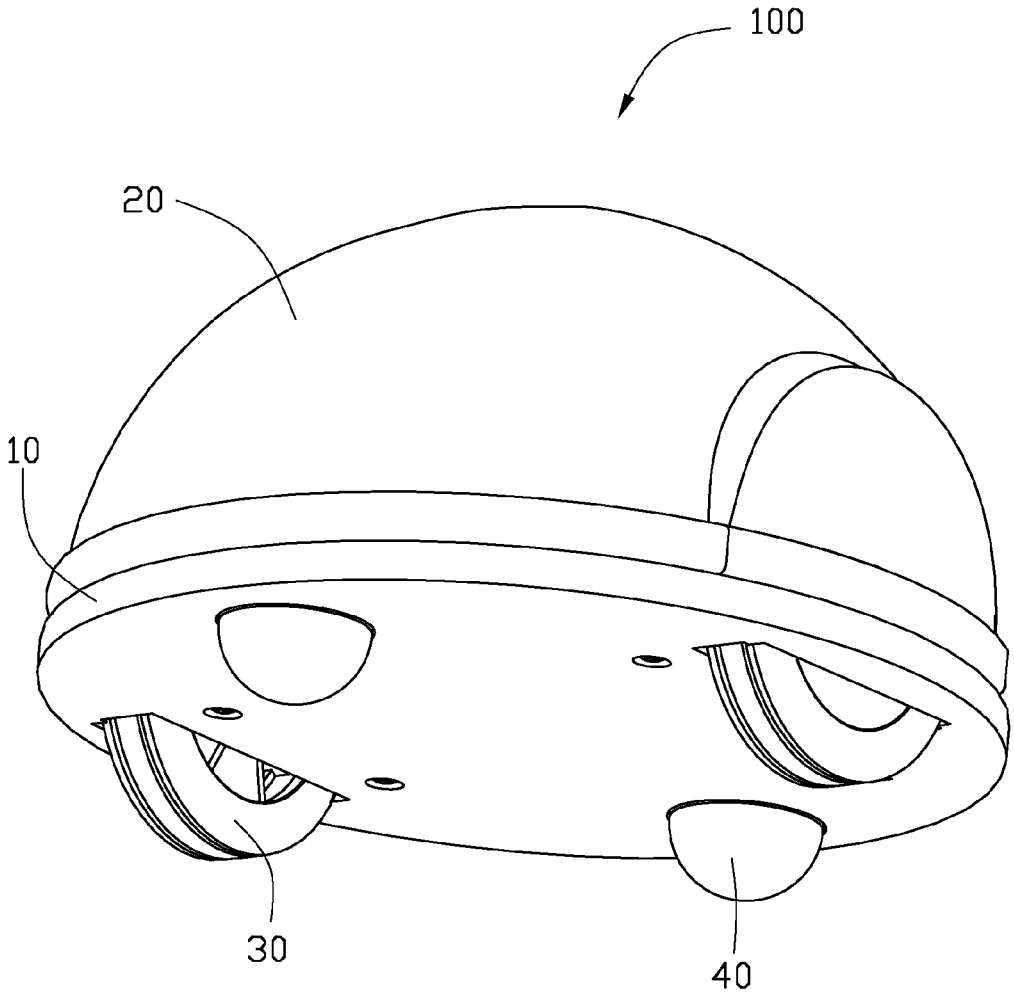
FIG. 1 is a schematic isometric view of a two-wheel toy car including a guiding member, according to a first exemplary embodiment.

Referring to FIG. 1, a two-wheel toy car 100, according to a first exemplary embodiment, includes a chassis 10, a car body 20, a wheel assembly 30, and two balancing assemblies 40. The chassis 10 is configured for supporting the car body 20. The wheel assembly 30 and the two balancing assemblies 40 are assembled to the chassis 10.

Figure 2:
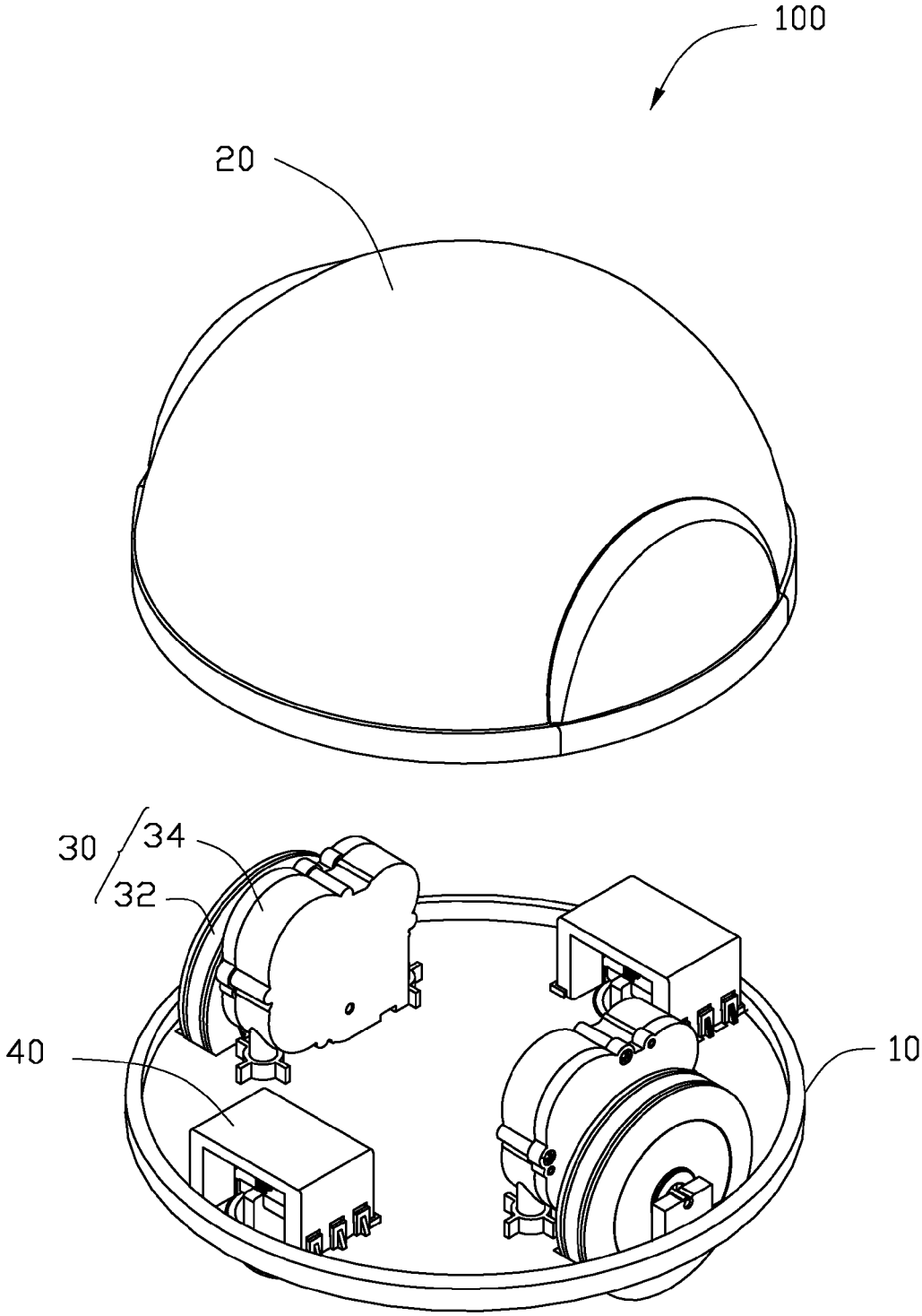
FIG. 2 is a partially exploded view of the two-wheel toy car of FIG. 1.
Figure 3:
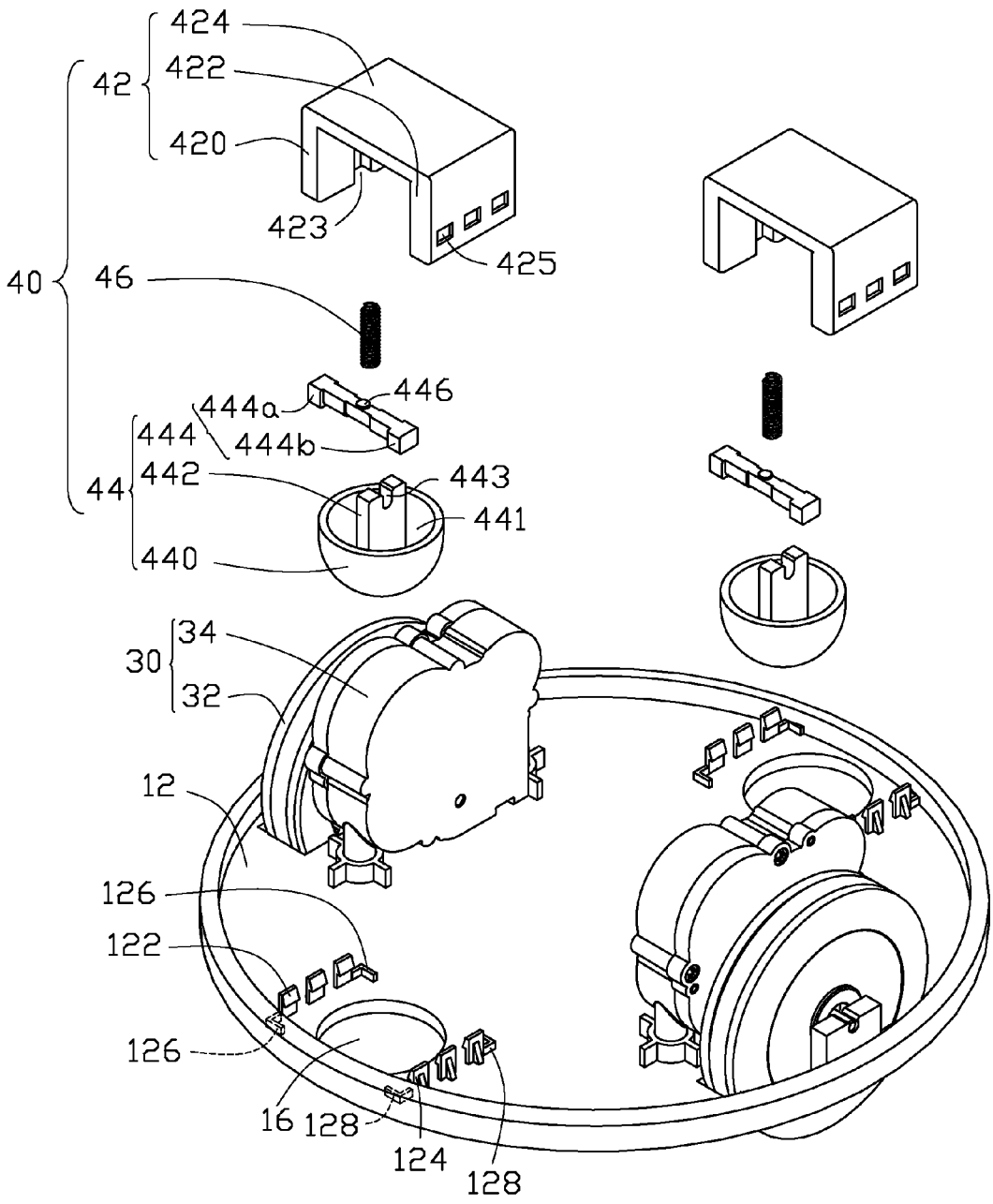
FIG. 3 is a further exploded view of the two-wheel toy car of FIG. 2.

Referring to FIGS. 2 and 3, the chassis 10 includes an inner surface 12 facing the car body 20. Two through holes 16 are symmetrically defined in the inner surface 12. Three first blocking portions 122 and three second blocking portions 124 are formed on the inner surface 12 at opposite sides of each through hole 16 and symmetrical to each other correspondingly. Two L-shaped first restraining portions 126 are formed on the inner surface 12 and face each other. The three first blocking portions 122 are positioned between the two first restraining portions 126. Two L-shaped second restraining portions 128 are formed on the inner surface 12 and face each other. The three second blocking portions 124 are positioned between the two second restraining portions 128.

The wheel assembly 30 includes two wheels 32 rotatably connected to the chassis 10 and two driving members 34 corresponding to the two wheels 32. The driving members 34 are configured for driving the two wheels 32 to rotate.

The two balancing assemblies 40 correspond to the two through holes 16. Each balancing assembly 40 includes a guiding member 42, a contacting member 44, and an elastic member 46 positioned between the guiding member 42 and the contacting member 44. The guiding members 42 correspond to the through holes 16 correspondingly. The contacting member 44 faces the guiding member 42 and extends through the through hole 16.

Figure 4:
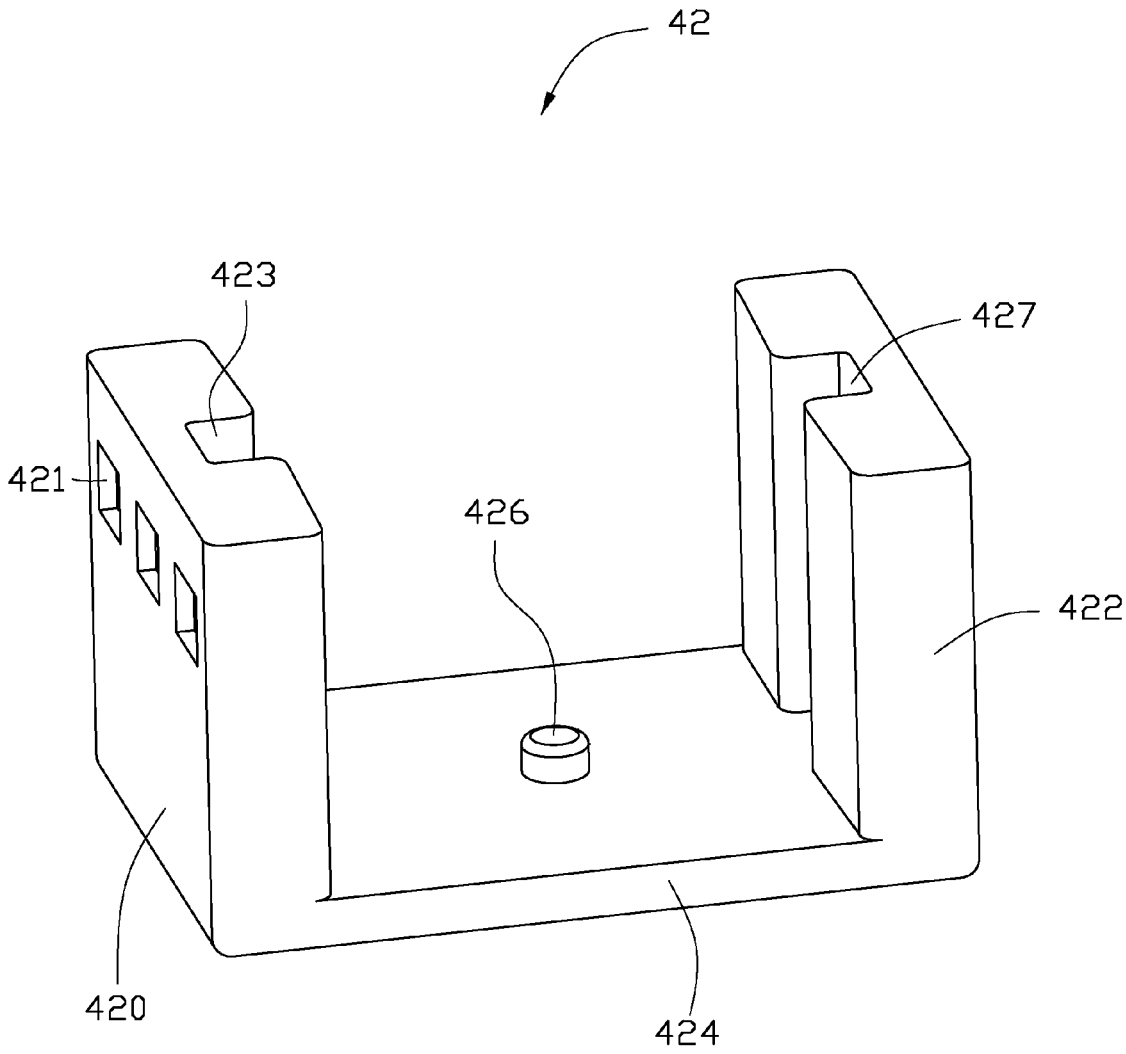
FIG. 4 is a schematic isometric view of the guiding member of the two-wheel toy car of FIG. 1.

Referring to FIGS. 3 and 4, the guiding member 42 is fixed to the inner surface 12 and faces the through hole 16. The guiding member 42 includes a first sidewall 420, a second sidewall 422 opposite to the first sidewall 420, and a top wall 424 perpendicularly connecting the first sidewall 420 to the second sidewall 422. Three first blocking grooves 421 are defined in an outer surface of the first sidewall 420 corresponding to the three first blocking portions 122. A first guiding slot 423 is defined in an inner surface of the first sidewall 420, adjacent to the through hole 16. Three second blocking grooves 425 are defined in an outer surface of the second sidewall 422 corresponding to the three second blocking portions 124. A second guiding slot 427 is defined in an inner surface of the second sidewall 422, adjacent to the through hole 16. The first sidewall 420 is positioned by the two first restraining portions 126. The first blocking portions 122 engage in the first blocking grooves 421 correspondingly. The second sidewall 422 is positioned by the two second restraining portions 128. The second blocking portions 124 engage in the second blocking grooves 425 correspondingly. Thus, the guiding member 42 is fixed on the inner surface 12 with the guiding member 42 aligned with the through hole 16. A first post 426 is formed on the top wall 424 and faces the through hole 16. In other alternative embodiment, the guiding member 42 may be fixed to the inner surface 12 by adhesive, screw joint or welding.

The contacting member 44 is partially received in the through hole 16. The contacting member 44 includes a hemispheroidal contacting portion 440, a supporting portion 442, and a connecting portion 444. A cavity 441 is defined in the contacting portion 440 and faces the top wall 424. The supporting portion 442 is fixed in the cavity 441, aligned with the first post 426. A U-shaped cutout 443 is defined in a distal end of the supporting portion 442. The connecting portion 444 includes a first connecting end 444*a* and a second connecting end 444*b* opposite to the first connecting end 444*a*. A second post 446 is formed on the connecting portion 444 corresponding to the first post 426. The connecting portion 444 is fixed to the supporting portion 442 through the U-shaped cutout 443 by adhesive. The first connecting end 444*a* is slidably received in the first guiding slot 423 and abuts against the inner surface 12. The second connecting end 444*b* is slidably received in the second guiding slot 427 and abuts against the inner surface 12. In other alternative embodiment, the connecting portion 444 may be fixed to the supporting portion 442 by welding or tight fitted with the U-shaped cutout 443.

The elastic member 46 is a compression spring. One end of the elastic member 46 is sleeved on the first post 426 and abuts against the top wall 424, and the other end of the elastic member 46 is sleeved on the second post 446 and abuts against the connecting portion 444.

When the two-wheel toy car 100 moves as the driving members 34 drive the two wheels 32 to rotate, the two wheels 32 and the two balancing assemblies 40 support as four supporting points. When the two-wheel toy car 100 tilts forward or backward, the contacting member 44 retracts into the through hole 16. The elastic member 46 becomes compressed by the contacting member 44 when retracting in the through hole 16. Therefore, a counterforce is applied by the compressed elastic member 46, forcing the chassis 10 to remain in a horizontal position and thereby stabilizing the two-wheel toy car 100.

Figure 5:
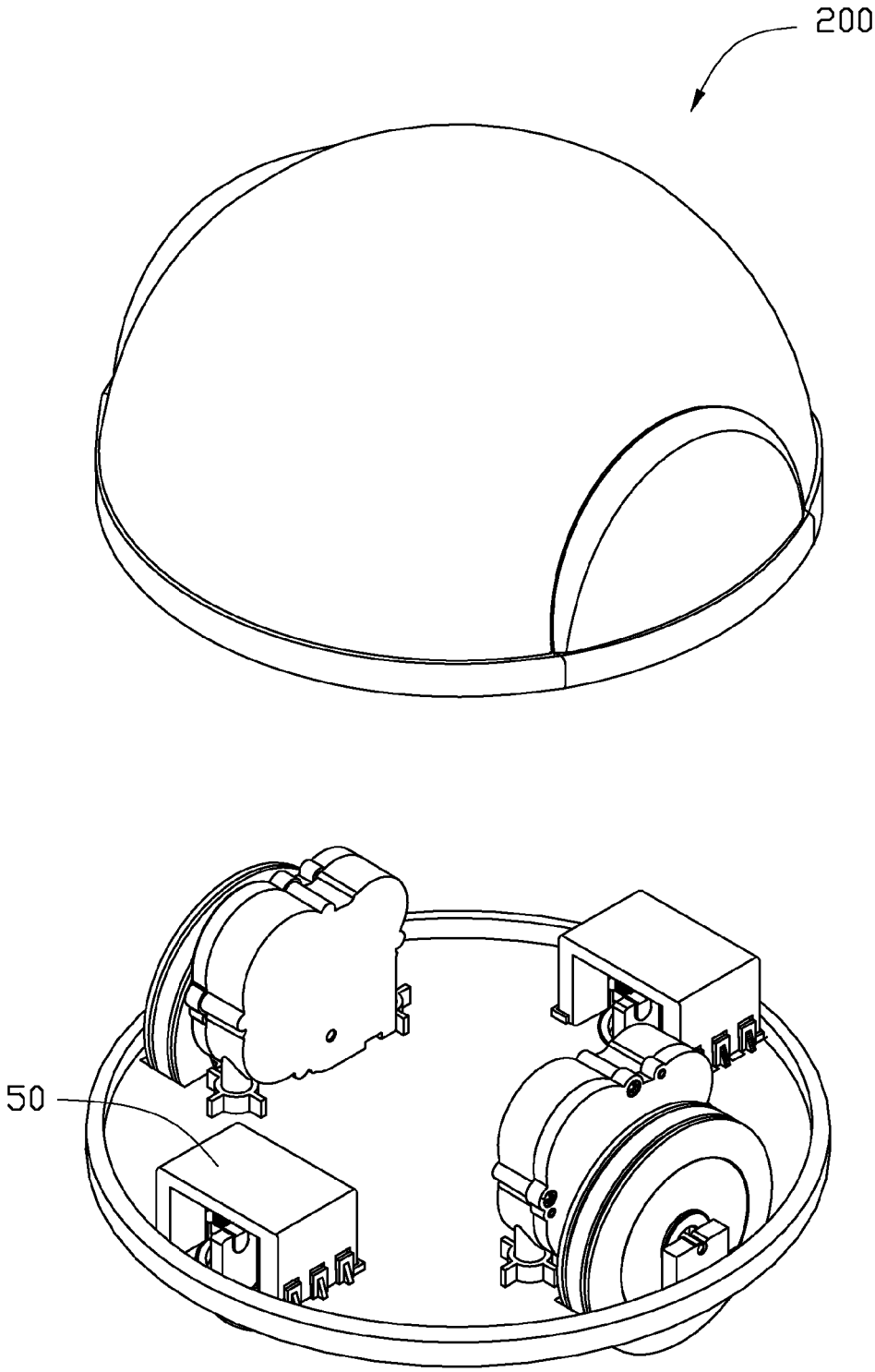
FIG. 5 is a partially exploded schematic isometric view of a two-wheel toy car including a guiding member, according to a second exemplary embodiment.

Referring to FIG. 5, a two-wheel toy car 200 according to a second exemplary embodiment is shown. The difference between the two-wheel toy car 200 of this exemplary embodiment and the two-wheel toy car 100 of the first exemplary is the balancing assembly 50 is different.

Figure 6:
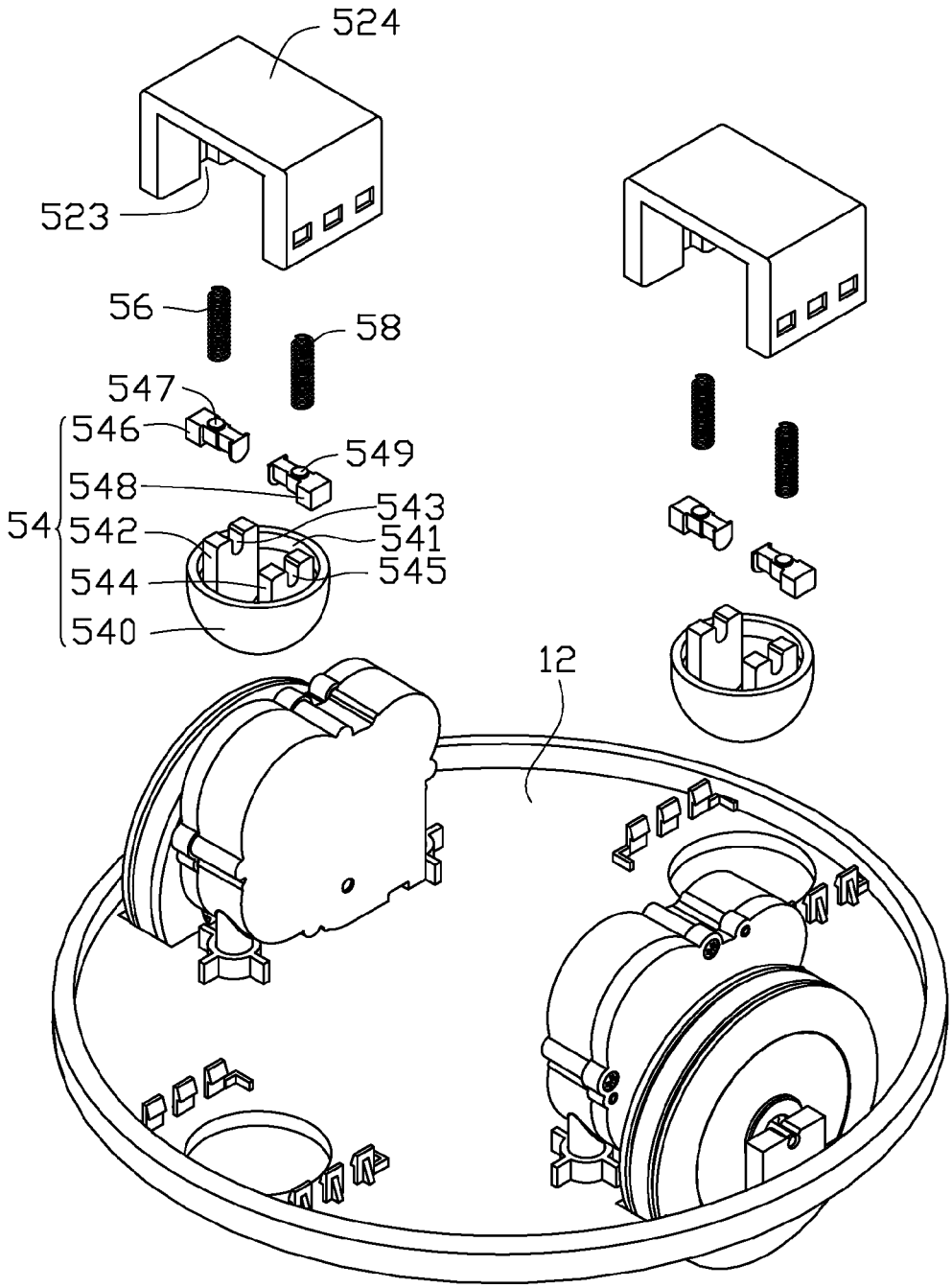
FIG. 6 is a further exploded view of the two-wheel toy car of FIG. 5.
Figure 7:
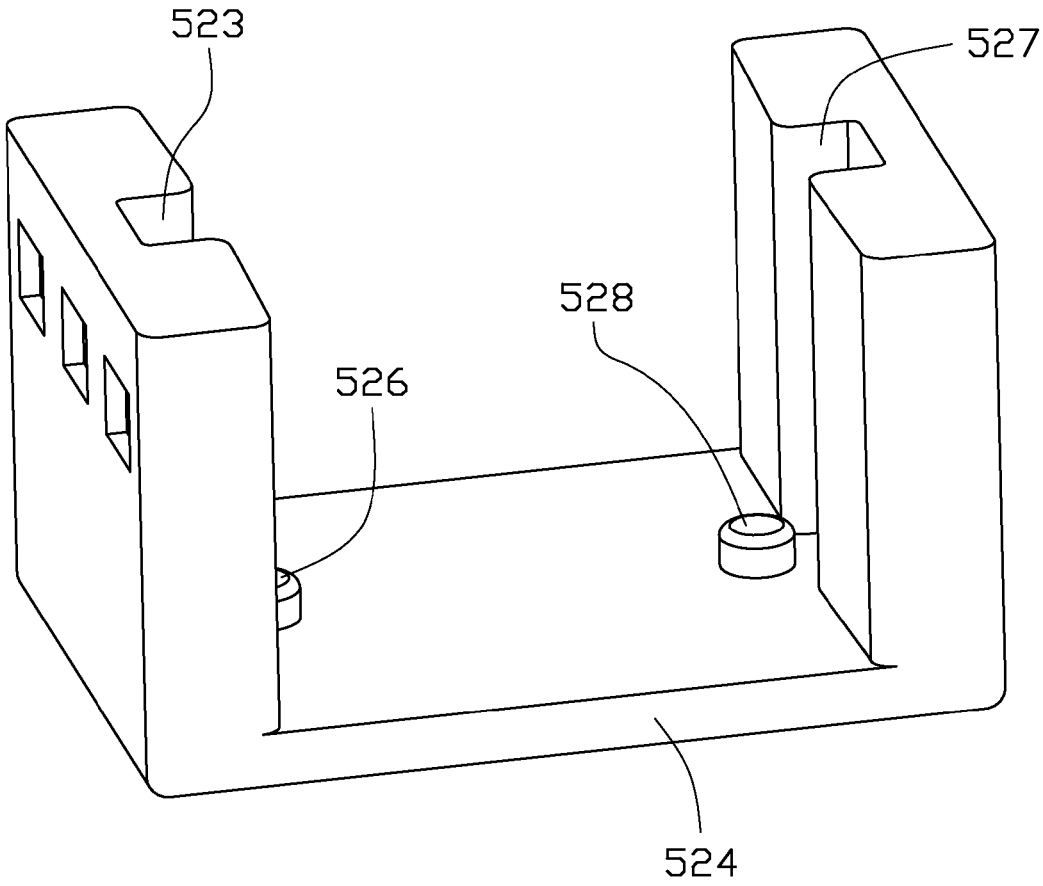
FIG. 7 is a schematic isometric view of the guiding member of the two-wheel toy car of FIG. 5.

Further referring to FIGS. 6 and 7, a first post 526 and a second post 528 are formed on the top wall 524 and face the contacting member 54 instead of the first post 426.

The contacting member 54 includes a first supporting portion 542, a second supporting portion 544, a first connecting portion 546, and a second connecting portion 548 instead of the supporting portion 442 and the connecting portion 444.

The first supporting portion 542 and the second supporting portion 544 are fixed in the cavity 541 of the contacting portion 540 and spaced from each other. A first U-shaped cutout 543 is defined in a distal end of the first supporting portion 542. One end of the first connecting portion 546 is fixed to the first supporting portion 542 through the first U-shaped cutout 543 by adhesive, and the other end of the first connecting portion 546 is slidably received in the first guiding slot 523 and abuts against the inner surface 12. A second U-shaped cutout 545 is defined in a distal end of the second supporting portion 544. One end of the second connecting portion 548 is fixed to the second supporting portion 544 through the second U-shaped cutout 545 by adhesive, and the other end of the second connecting portion 548 is slidably received in the second guiding slot 527 and abuts against the inner surface 12. A third post 547 is formed on the first connecting portion 546 corresponding to the first post 526. A fourth post 549 is formed on the second connecting portion 548 corresponding to the second post 528.

Each balancing assembly 50 includes a first elastic member 56 and a second elastic member 58 instead of the elastic member 46. One end of the first elastic member 56 is sleeved on the first post 526 and abuts against the top wall 524, and the other end of the first elastic member 56 is sleeved on the third post 547 and abuts against the first connecting portion 546. One end of the second elastic member 58 is sleeved on the second post 528 and abuts against the top wall 524, and the other end of the second elastic member 58 is sleeved on the fourth post 549 and abuts against the second connecting portion 548.

Advantages of the second embodiment are similar to those of the first embodiment. Further, when the two-wheel toy car 200 is unbalanced, the contacting member 54 retracts into the through hole 16. The first elastic member 56 and the second elastic member 58 are compressed when retracting into the through holes 16. Therefore, a counterforce is applied by the compressed first elastic member 56 and the second elastic member 58, against the unbalanced two-wheel toy car 200. As a result, the two-wheel toy car 200 becomes balanced again.

It is to be understood, however, that even though numerous characteristics and advantages of the present embodiments have been set fourth in the foregoing description, together with details of the structures and functions of the embodiments, the disclosure is illustrative only, and changes may be made in details, especially in matters of shape, size, and arrangement of parts within the principles of the invention to the full extent indicated by the broad general meaning of the terms in which the appended claims are expressed.

What is claimed is:

1. A two-wheel toy car comprising:

a car body;

a chassis configured for supporting the car body, the chassis comprising an inner surface facing the car body, two through holes defined in the chassis;

a wheel assembly fixed to the chassis, the wheel assembly comprising two wheels symmetrically positioned on the chassis and two driving members corresponding to the two wheels; the driving members configured for driving the two wheels; and two balancing assemblies fixed to the chassis corresponding to the two through holes; each balancing assembly comprising:

a guiding member fixed to the inner surface and aligned with the through hole;

a contacting member extending from the through hole, the contacting member slidably connected to the guiding member; and at least one elastic member extendably connecting the guiding member to the contacting member; wherein:

when the two wheel toy moves, the two wheels and the two balancing assemblies supports as four supporting points; and when the two wheel toy is unbalanced, the contacting member of one of the two balancing assemblies retracts into the through hole to compress the at least one elastic member of the one of the two balancing assemblies, thereby applying a counterforce to balance the two wheel toy.

2. The two-wheel toy car as claimed in claim 1, wherein the guiding member comprises a first sidewall, a second sidewall opposite to the first sidewall, and a top wall perpendicularly connecting the first sidewall to the second sidewall; the first sidewall and the second sidewall are fixed to the inner surface of the chassis; and the top wall faces the through hole.

3. The two-wheel toy car as claimed in claim 2, wherein three first blocking portions and three second blocking portions are formed on the inner surface of the chassis at opposite sides of the through hole and symmetrical to each other, correspondingly; three first blocking grooves are defined in an outer surface of the first sidewall corresponding to the three first blocking portions; three second blocking grooves are defined in an outer surface of the second sidewall corresponding to the three second blocking portions; each first blocking portion engages in the corresponding first blocking groove; and each second blocking portion engages in the corresponding second blocking groove so that the guiding member is fixed to the inner surface of the chassis.

4. The two-wheel toy car as claimed in claim 3, wherein two first restraining portions are formed on the inner surface of the chassis at two sides of the three first blocking portions and face each other; two second restraining portions are formed on the inner surface of the chassis at two sides of the three second blocking portions and face each other; the first sidewall is positioned by the two first restraining portions; and the second sidewall is positioned by the two second restraining portions.

5. The two-wheel toy car as claimed in claim 3, wherein a first guiding slot is defined in an inner surface of the first sidewall adjacent to the through hole; a second guiding slot is defined in an inner surface of the second sidewall adjacent to the through hole; the contacting member comprises a contacting portion and a connecting portion fixed to the contacting portion; the connecting portion comprises a first connecting end and a second connecting end opposite to the first connecting end; the first connecting end is slidably received in the first guiding slot and abuts against the inner surface of the chassis; and the second connecting end is slidably received in the second guiding slot and abuts against the inner surface of the chassis.

6. The two-wheel toy car as claimed in claim 5, wherein the contacting member further comprises at least one supporting portion; the contacting portion is hemispheroidal; a cavity is defined in the contacting portion and faces the top wall; the at least one supporting portion is fixed in the cavity; and the connecting portion is fixed to the at least one supporting portion.

7. The two-wheel toy car as claimed in claim 6, wherein a first post is formed on the top wall and faces the through hole; a second post is formed in the connecting portion corresponding to the first post; the at least one elastic member comprises one elastic member; one end of the elastic member is sleeved on the first post and abuts against the top wall; and the other end of the elastic member is sleeved on the second post and abuts against the connecting portion.

8. The two-wheel toy car as claimed in claim 6, wherein a U-shaped cutout is formed on a distal end of the supporting portion; and the connecting portion is fixed to the supporting portion through the U-shaped cutout by adhesive, welding, or tight fitted with the U-shaped cutout.

9. The two-wheel toy car as claimed in claim 3, wherein a first guiding slot is defined in an inner surface of the first sidewall adjacent to the through hole; a second guiding slot is defined in an inner surface of the second sidewall adjacent to the through hole; the contacting member comprises a contacting portion, a first connecting portion and a second connecting portion fixed to the contacting portion; one end of the first connecting portion is slidably received in the first guiding slot and abuts against the inner surface of the chassis; and one end of the second connecting portion is slidably received in the second guiding slot and abuts against the inner surface of the chassis.

10. The two-wheel toy car as claimed in claim 9, wherein the contacting member further comprises a first supporting portion and a second supporting portion; the contacting portion is hemispheroidal; a cavity is defined in the contacting portion and faces the top wall; the first supporting portion and the second supporting portion are fixed in the cavity and spaced from each other; the other end of the first connecting portion is fixed to the first supporting portion; and the other end of the second connecting portion is fixed to the second supporting portion.

11. The two-wheel toy car as claimed in claim 9, wherein a first post and a second post are formed on the top wall and face the contacting member; a third post is formed on the first connecting portion corresponding to the first post; a fourth post is formed on the second connecting portion corresponding to the second post; the at least one elastic member comprises a first elastic member and a second elastic member; one end of the first elastic member is sleeved on the first post and abuts against the top wall; the other end of the first elastic member is sleeved on the third post and abuts against the first connecting portion; one end of the second elastic member is sleeved on the second post and abuts against the top wall; and the other end of the second elastic member is sleeved on the fourth post and abuts against the second connecting portion.

12. The two-wheel toy car as claimed in claim 10, wherein a first U-shaped cutout is formed on a distal end of the first supporting portion; the first connecting portion is fixed to the first supporting portion through the first U-shaped cutout by adhesive, welding or tight fitted with the first U-shaped cutout; a second U-shaped cutout is formed on a distal end of the second supporting portion; and the second connecting portion is fixed to the second supporting portion through the second U-shaped cutout by adhesive, welding or tight fitted with the second U-shaped cutout.

* * * * *